United States Patent [19]

Brown

[11] 4,162,753

[45] Jul. 31, 1979

[54] NECKTIE HANGER

[76] Inventor: William R. Brown, 4815 W. 61 Ter., Mission, Kans. 66205

[21] Appl. No.: 924,177

[22] Filed: Jul. 13, 1978

[51] Int. Cl.[2] ..... A47J 51/097

[52] U.S. Cl. ..... 223/85; 223/95; 211/119

[58] Field of Search ..... 223/85, 87, 88, 95; 211/113, 119, 13, 119.12; 24/237

[56] References Cited

U.S. PATENT DOCUMENTS

| | | | |
|---|---|---|---|
| 2,108,853 | 2/1938 | Ghazal | 223/92 |
| 2,264,957 | 12/1941 | Shafarman | 223/87 |
| 2,338,213 | 1/1944 | Steenland | 24/237 |
| 2,488,973 | 11/1949 | Hall | 223/87 |
| 2,514,501 | 7/1950 | Marica et al. | 223/88 X |
| 2,877,939 | 3/1959 | Dolnick | 223/88 |
| 3,469,287 | 9/1969 | Hamline | 211/119.12 |
| 3,563,429 | 2/1971 | Monks | 211/119 |

*Primary Examiner*—George H. Krizmanich
*Attorney, Agent, or Firm*—Fishburn, Gold & Litman

[57] ABSTRACT

A necktie hanger, formed of a single continuous length of wire, has an attachment hook and a pair of downwardly extending, coplanar spaced limbs with a crossarm extending between the limbs. The crossarm is of a length commensurate with the width of a lateral midportion of a necktie to be draped over the crossarm and suspended from the hanger. An eye located between the hook and the limbs is provided for tethering the hanger to a suitable anchor.

3 Claims, 4 Drawing Figures

NECKTIE HANGER

The present invention relates to necktie hangers, and in particular, to a hanger for accommodating a plurality of superposed neckties for convenient storage.

Of continuing annoyance to the traveling man are difficulties concerning the convenient and secure storage of neckties without undue mussing or wrinkling. Too often the traveler packs his neckties in a garment or suitbag by draping the necktie around a suit suspended on the internal hanger attachment bar of the bag. After the jostling of travel, frequently the neckties are found in a wrinkled heap at the bottom of the bag. This creates a dishelved appearance for the traveler who may have to don the necktie and attend an important meeting.

Moreover, home storage of neckties is often haphazard whereby neckties are draped over common coathangers or clothes hooks. This is often less than satisfactory for the neckties are not well secured to the hanger and easily become skewed on the hanger and fall to the floor.

Numerous necktie hangers and racks are known in the prior art for storing a plurality of neckties or the like garments. These are generally relatively bulky or complex structures which are comparatively expensive relative to the present invention and adapted for long term home use rather than short term use by a traveler. Moreover, the prior art structures often occupy substantial space which is disadvantageous for a traveler.

The principal objects of the present invention are: to provide a compact necktie hanger structure; to provide a necktie hanger which may be simply formed from a single, continuous length of wire; to provide a necktie hanger having a spaced limbs and a crossarm forming an opening of a size commensurate with the width of a longitudinal midportion of a necktie to restrain the tie from lateral sliding movement; to provide a necktie hanger having an eye for tethering the hanger to a suitable anchor; to provide a necktie hanger of which a second necktie hanger of like shape can be reversed in hanging orientation, positioned adjacent the first hanger and tethered together; and to provide such a necktie hanger which is relatively inexpensive, sturdy and efficient in use and particularly well adapted for the intended purpose.

Other objects and advantages of this invention will become apparent from the following description taken in connection with the accompanying drawings wherein are set forth, by way of illustration and example, certain embodiments of this invention.

Figure 1:
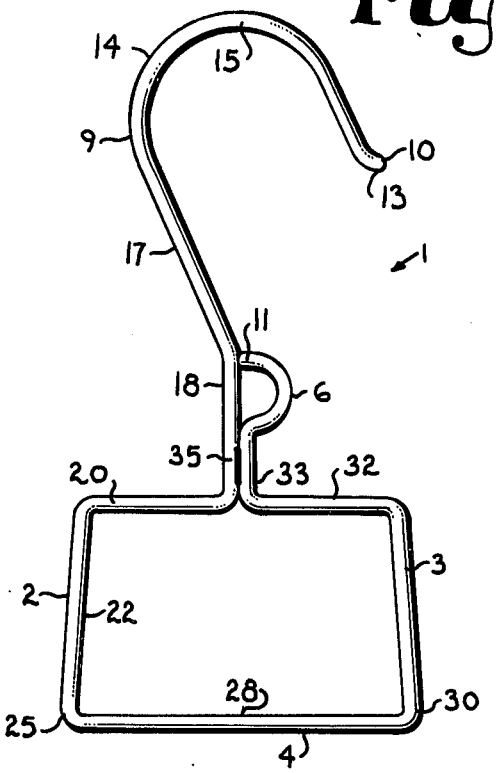
FIG. 1 is a front elevational view of a necktie hanger embodying the present invention.

Referring to the drawings in more detail:

As required, detailed embodiments of the present invention are disclosed herein, however, it is to be understood that the disclosed embodiments are merely exemplary of the invention which may be embodied in various forms, therefore, specific structural and functional details disclosed herein are not to be interpreted as limiting, but merely as a basis for the claims and as a representative basis for teaching one skilled in the art to variously employ the present invention in virtually any appropriately detailed structure.

The reference numeral 1, FIG. 1, generally indicates a necktie hanger embodying the present invention. The hanger 1 includes a pair of coplanar limbs 2 and 3 spaced from each other and having a crossarm 4 extending therebetween for draping a single necktie 5, FIG. 4, thereover and between the limbs 2 and 3 or for receiving a plurality of superposed neckties 5. An eye 6 is included for tethering the hanger 1 to a suitable anchor and arresting free movement thereof.

The necktie hanger 1 is shaped from a relatively heavy and sturdy material, such as #9 gauge steel wire 9 which may be chrome plated or otherwise finished after bending operations to inhibit corrosion and present a pleasing appearance. Preferably, the wire 9 is a single, continuous piece and has opposite wire ends 10 and 11 bent to form the hanger 1, as described below. However, it is not necessary that a single continuous wire 9 be employed and the hanger 1 may be formed of a plurality of wire segments joined together and separately comprising the various portions of the hanger 1 described below.

In the following description, references are made to upper and lower positions as would be in accord with the orientation of the necktie hanger 1 during use.

The wire end 10 forms part of attachment means for suspending the hanger 1 from a hanger rack. In the illustrated example, the wire end 10 extends generally downwardly and is slightly upturned to facilitate hanging over a hanger rack. A hook portion 14 has an apex at 15 and curves downwardly into a hook shank 17 extending a distance below the hook portion 14 to permit suspending the necktie hanger 1 from a hanger rack. The hook shank 17 is substantially straight and joins with a generally vertical, coplanar hanger shank 18 which is vertically aligned with the hook apex 15.

Continuing downwardly, the hanger shank 18 joins a substantially straight, horizontal first spreader portion 20 which forms one portion of an opening 22 through which passes the necktie 5. The first spreader portion 20 joins a downwardly and slightly outwardly extending first limb 22 which forms a side wall of the opening 22 and which, in the illustrated example, is of sufficient dimension to accommodate a plurality of superposed neckties 5.

Figure 3:
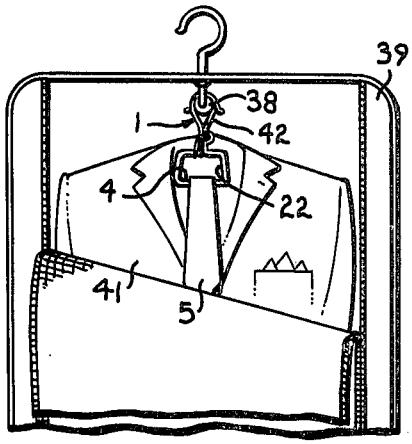
FIG. 3 is a front elevational view of the necktie hanger with a necktie suspended therefrom and connected to an attachment bar of a garment or suitbag.
Figure 2:
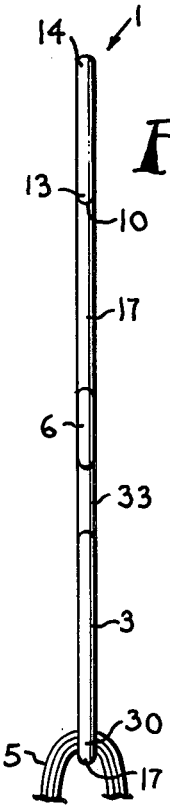
FIG. 2 is a side elevational view of the necktie hanger showing the coplanar, relatively thin aspect thereof and having a plurality of superposed neckties suspended therefrom.
Figure 4:
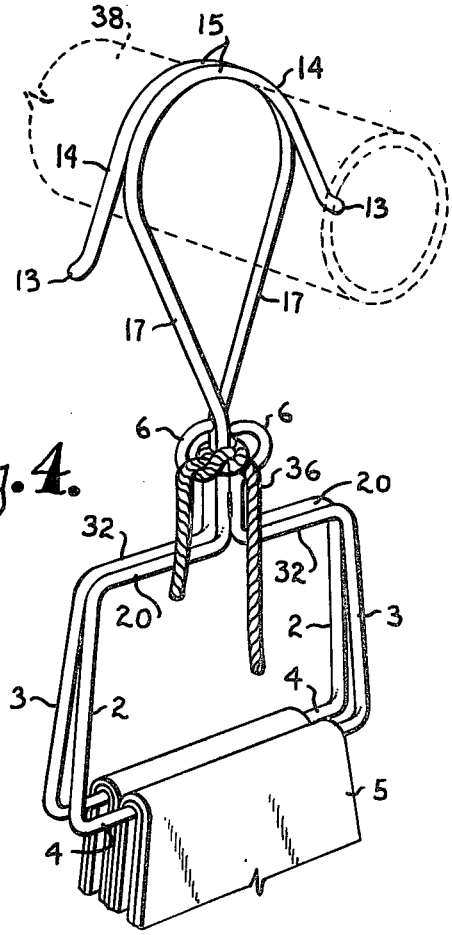
FIG 4 is a perspective view of a pair of necktie hangers reversed in hanging orientation from each other and having a plurality of superposed neckties suspended thereby and with a flexible line tethering the hangers together.

The first limb 22 terminates at lower end 25 which is joined to a straight, horizontal, crossarm 4 over which are draped the neckties 5, FIGS. 2–4. A mid-longitudinal portion 28 of the crossarm 4 is located generally vertically aligned with and spaced from the hanger shank 18 for balance of the hanger 1. The crossarm 4 joins an upwardly and slightly inwardly extending second limb 3 at the limb lower end 30. The first and second limbs 2 and 3 are of equal length and, in accord with the first limb 2, the second limb 3 is joined to a second spreader portion 32 which extends between the second limb 2 and the hanger shank 18. The first and second spreader portions 20 and 32 are coaxially aligned and run parallelly and coplanar to the crossarm 4, thereby defining a slightly trapezoidal opening 22 through cooperation with the side wall forming first and second limbs 23 and 29. The length of the crossarm 4 and the distance between the limb ends 25 and 30 are preferably of a dimension commensurate with the width of a longitudinal midportion of a necktie 5 in order to prevent significant lateral sliding of the necktie 5 on the crossarm 4. It will be appreciated that the generally trapezoidal orientation opening 22 caused by the converging limbs 2 and 3 permits a plurality of neckties 5 to be superposed and draped together on the crossarm 4. Additionally, the converging arms 2 and 3 tend to squeeze some of the uppermost neckties 5 in a superposed bunch thereof together to inhibit slipping off the crossarm 4.

A straight portion 33 extends upwardly from the second spreader portion 32 and lies parallel and adjacent to the hanger shank 18. The straight portion 33 is secured to the hanger shank 18 as by spot welding at 35 in a smooth and strong juncture. Continuing upwardly therefrom, the wire 9 forms a coplanar circular bend defining the eye 6 which terminates at the wire end 11 contacting the hanger shank 18. Further, it will be appreciated that the coplanar, relatively thin, side aspect of the hanger 1, FIG. 2, uses a minimum of space when the hanger 1 is used or stored.

A tether, such as a cord 36 or other suitable flexible line connector, is passed through the eye 6 and connected to a suitable anchor for arresting free movement of the hanger. Suitable anchors may include a fixed ring or the like or another hanger, as described below. A use of the necktie hanger 1 is shown in FIG. 3 whereby the hook portion 14 of the hanger is connected to a hanger rack 38 of a garment or suitbag 39, such as is likely to be carried by a traveler. In the illustrated example, garments connected to the hanger rack 38 include a suit 41 on a conventional clothes hanger 42 which is suspended from the hanger rack 38. A necktie 5 passes through the hanger opening 22 and draped at the tie longitudinal midportion over the crossarm 4. The necktie hanger 1 is positioned adjacent the clothes hanger 42 with the hanger hook end 13 reversed in orientation from that of the clothes hanger 42. A cord 36 is passed through the eye 6 and wrapped around the adjoining shank of the clothes hanger 42 and tied to bind the necktie hanger 1 and the clothes hanger 42 together to prevent the hangers 1 and 42 from coming off the hanger rack 36 through rough handling or tossing of the suitbag 39.

Alternatively, a pair of necktie hangers 1 may be suspended on a hanger rack 38, FIG. 4, such as an automobile clothes bar, and each reversed from the other in direction in orientation of the hook end 13. As illustrated, a plurality of superposed neckties 5 may be draped from each hanger 1. The cord 36 is passed through both eyes 6 and ties to secure each hanger 1 together and prevent the hangers from swinging free from the hanger rack 38 during jostling or transport. Additionally, tying the hangers 1 together causes the neckties 5 draped on each hanger 1 to press together and thereby retained from slippage on the respective crossarm 4.

It is to be understood that while one form of this invention has been illustrated and described, it is not to be limited to the specific form or arrangement of parts herein described and shown, except insofar as such limitations are included in the following claims.

What is claimed and desired to secure by Letters Patent is:

1. A necktie hanger formed of a continuous wire and comprising:

(a) a curved hook portion including an apex and a downwardly extending hook shank for suspending said hanger from a hanger rack;

(b) a generally vertical coplanar hanger shank merged with said hook shank and vertically aligned with said hook apex;

(c) a substantially straight and horizontal coplanar first spreader portion connected to said hanger shank;

(d) a downwardly and slightly outward extending coplanar first limb having a lower end;

(e) a horizontal, coplanar crossarm having opposite ends, one end being joined to said first limb lower end and extending a distance commensurate with the width of a longitudinal midpointion of a necktie to be draped over said crossarm, said crossarm having a longitudinal midportion vertically aligned with said hanger shank and said hook apex for balance of said hanger;

(f) an upwardly and slightly inwardly extending coplanar second limb having a lower end connected to the other end of said crossarm;

(g) a substantially straight and horizontal coplanar second spreader portion connected to said second limb and extending toward said hanger shank whereby a trapezoidal opening for receipt of neckties is defined by said first and second spreader portion, said first and second limbs and said crossarm;

(h) a coplanar eye connected to said second spreader portion and having portions lying against said hanger shank, said eye and said hanger shank being connected by a weld formation; and (i) a flexible line connector tied to said hanger through said eye for tethering said hanger to an anchor.

2. A necktie hanger formed of a continuous length of wire and comprising:

(a) a curved supporting hook portion with a downwardly extending shank;

(b) an eye on said shank coplanar with said hook portion for connection to a tether;

(c) spreader arms positioned below said shank and said eye and extending outwardly of said shank in opposite directions coplanar with said hook portion;

(d) a horizontal crossarm positioned below said spreader arms in generally parallel and coplanar relation therewith; and (e) spaced limbs extending between and generally connecting said spreader arms to said crossarm and defining an opening for receiving and draping a necktie over said crossarm.

3. A necktie hanger set forth in claim 2 including:

(a) two said necktie hangers having said hook portions open in opposite directions; and (b) a flexible line connector passed through said eyes and tethering said necktie hangers together whereby said hook portions are adapted to engage a hanger rack in complementary relation with said hook portions open in opposite directions and are inhibited from disengagement from the hanger rack.

* * * * *